US007325342B2

(12) United States Patent
Coe

(10) Patent No.: US 7,325,342 B2
(45) Date of Patent: Feb. 5, 2008

(54) MULTIPLE OBJECT DISPLAY SYSTEM

(76) Inventor: George Coe, 1885 Vista Del Lago, Auburn, CA (US) 95603

( * ) Notice: Subject to any disclaimer, the term of this patent is extended or adjusted under 35 U.S.C. 154(b) by 125 days.

(21) Appl. No.: 11/142,521

(22) Filed: Jun. 1, 2005

(65) Prior Publication Data

US 2006/0283064 A1 Dec. 21, 2006

Related U.S. Application Data

(60) Provisional application No. 60/576,222, filed on Jun. 1, 2004.

(51) Int. Cl.
*G09F 19/00* (2006.01)
*A47F 5/12* (2006.01)
*A47F 5/00* (2006.01)

(52) U.S. Cl. ..... 40/533; 211/169; 211/162

(58) Field of Classification Search ..... 40/533, 40/530, 370–405; 211/162, 169, 163, 171, 211/169.1, 47, 48; 248/486
See application file for complete search history.

(56) References Cited

U.S. PATENT DOCUMENTS

| | | | | |
|---|---|---|---|---|
| 132,314 | A | 10/1872 | Moulton | |
| 228,451 | A | 6/1880 | Doubler | |
| 506,073 | A | 10/1893 | Prentis | |
| 540,011 | A | 5/1895 | Wiederer | |
| 574,973 | A | 1/1897 | Wiediger | |
| 835,615 | A | 11/1906 | Henricks | |
| 857,391 | A | 6/1907 | Goldberg | |
| 1,207,456 | A | 12/1916 | Whelan | |
| 1,326,832 | A | 12/1919 | Baily | |
| 1,360,532 | A * | 11/1920 | Isaacs et al. | 190/16 |
| 1,881,636 | A | 10/1932 | Johnson | |
| 1,958,579 | A | 5/1934 | Johnson | |
| 2,086,443 | A | 6/1937 | Rutyna | |
| 2,545,362 | A | 3/1951 | Kenney | |
| 3,286,382 | A | 11/1966 | Newman | |
| 3,391,796 | A * | 7/1968 | Cross | 211/169 |
| 3,460,282 | A | 8/1969 | Swirsky | |
| 4,005,536 | A | 2/1977 | Fanning, Jr. | |
| 4,423,563 | A | 1/1984 | Ondricek | |
| 4,885,857 | A * | 12/1989 | Leflet | 40/533 |
| 6,237,782 | B1 | 5/2001 | Hunn | |
| 6,578,305 | B2 | 6/2003 | Lebrun | |
| 2005/0011846 | A1 * | 1/2005 | Stein | 211/169 |

* cited by examiner

*Primary Examiner*—Lesley D. Morris
*Assistant Examiner*—Syed A Islam
(74) *Attorney, Agent, or Firm*—Temmerman Law Office; Mathew J. Temmerman

(57) ABSTRACT

A display system for wall or table use which incorporates multiple two-sided display panels that allow either face of the panels to be viewed and to lie parallel with adjacent panels when rotated 180 degrees from one side of the device to the other is disclosed. Suitable for home, office, or commercial use, the construction of the device presents a decorative appearance and provides for display of multiple images or small objects, or a combination of small objects and images. The construction of the device allows the device to be wall mounted or attached to a base and used as table display. The device can be economically configured for portrait or landscape orientation of popular sized displays. Using the same components, customized versions can be economically fabricated. A variety of materials can be used to construct the display system.

6 Claims, 13 Drawing Sheets

MULTIPLE OBJECT DISPLAY SYSTEM

FIELD OF INVENTION

This patent application claims priority from provisional patent application Ser. No. 60/576,222, filed Jun. 1, 2004.

BACKGROUND

Adequate wall space and/or table space for the display of photographs, images, and small objects is frequently lacking in many homes and offices. The same is true for commercial facilities where display space has an economic value. Decorative space-saving display devices compatible with a wide spectrum of decors that have multiple display faces, and that can house a wide range of image sizes are not readily available.

SUMMARY OF THE INVENTION

The invention is a space-saving display system incorporating fixed-displays and multiple moveable two-sided display panels for use in viewing images or small objects.

This invention relates to the display of objects retained in multiple two-sided display panels. These panels can be viewed in user selected facing pairs in which the front face of one display panel is visible at the same time as the back face of an adjacent display panel. The device can be mounted on a vertical surface with the display panels oriented for operation in a horizontal or vertical position; or be mounted on a baseplate that stands on a flat surface such as a table or counter, with the display panels oriented for operation in a horizontal direction.

The principal object of this invention is to allow use of multiple display panels in a space slightly larger than that of one or at most two display panels, and to allow rotation of the nested display panels for sequential viewing of any two pairs of facing images/item sides of display panels. All the moveable display panels can be rotated away from stationary plane behind them (a backplane) for viewing and then nested in a stack of panels parallel to the backplane without compromise of the decorative value of the device. In a preferred embodiment the field of rotation is a 180-degree arc, but an arc greater than 180 degrees yet substantially close to 180 degrees is also disclosed.

An additional object of this invention is to minimize the projection of the stack of display panels away from the mounted surface.

A further object of the invention is to allow rotation of a display panel for viewing anywhere in a 180-degree or greater arc.

A further object of the invention is to allow the rotation of the moveable display panels of a single fixed-display embodiment over an adjacent display such as an ordinary picture, without contact with the adjacent display.

A further object of the invention is to allow changeability of the images or items retained in the display panels without disturbing the mounting of the display system.

A further object of the invention is to allow fabrication with either non-detachable or detachable two-sided moveable display panels.

A further object of the invention is to allow the number of display panels installed in a system to be easily changed.

Other objects, features, and advantages of the invention will be apparent from the detailed description that follows the brief description of the drawings, when read with reference to the accompanying drawings.

DETAILED DESCRIPTION OF THE INVENTION

The description of the invention is divided into three sections, a physical description section describing the components of the display system, a functional description section describing the concepts underlying the invention and the invention in operation, and an other embodiments section describing other embodiments of the invention having more than four moveable panels.

Figure 1:
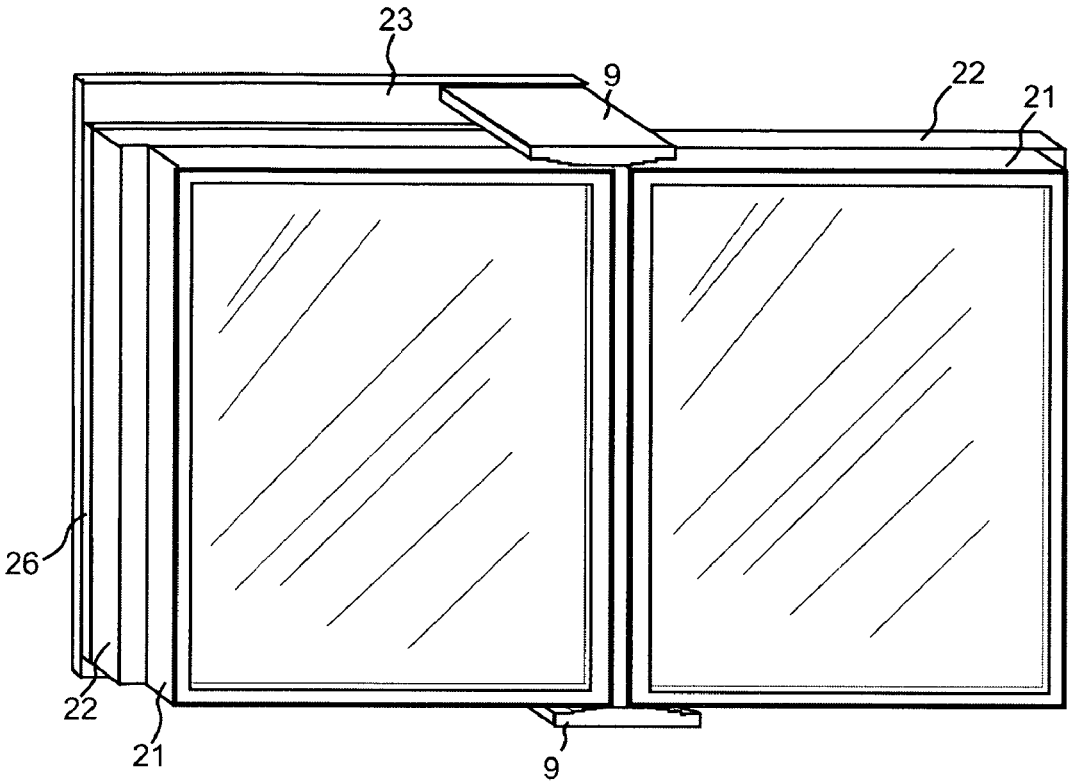
FIG. 1 is a perspective view of a display system incorporating one fixed-display and four moveable display panels according to an embodiment of the present invention.

Because the moveable panels and U shaped retention structures in this invention are two-sided and the side facing away from the backplane of the invention varies with the configuration of the invention, defining the left and right side of these moveable parts is helpful. See FIGS. 1 and 24. Referring to FIG. 1, the "left" side of a moveable panel or U shaped retention structure is the side of the structure parallel to and nearest the axis of rotation of the structure. The "right" side of the structure is the side parallel to and farthest away from the axis of rotation of the structure. The words "top" and "bottom" are defined with respect to the image associated with their usage.

Figure 24:
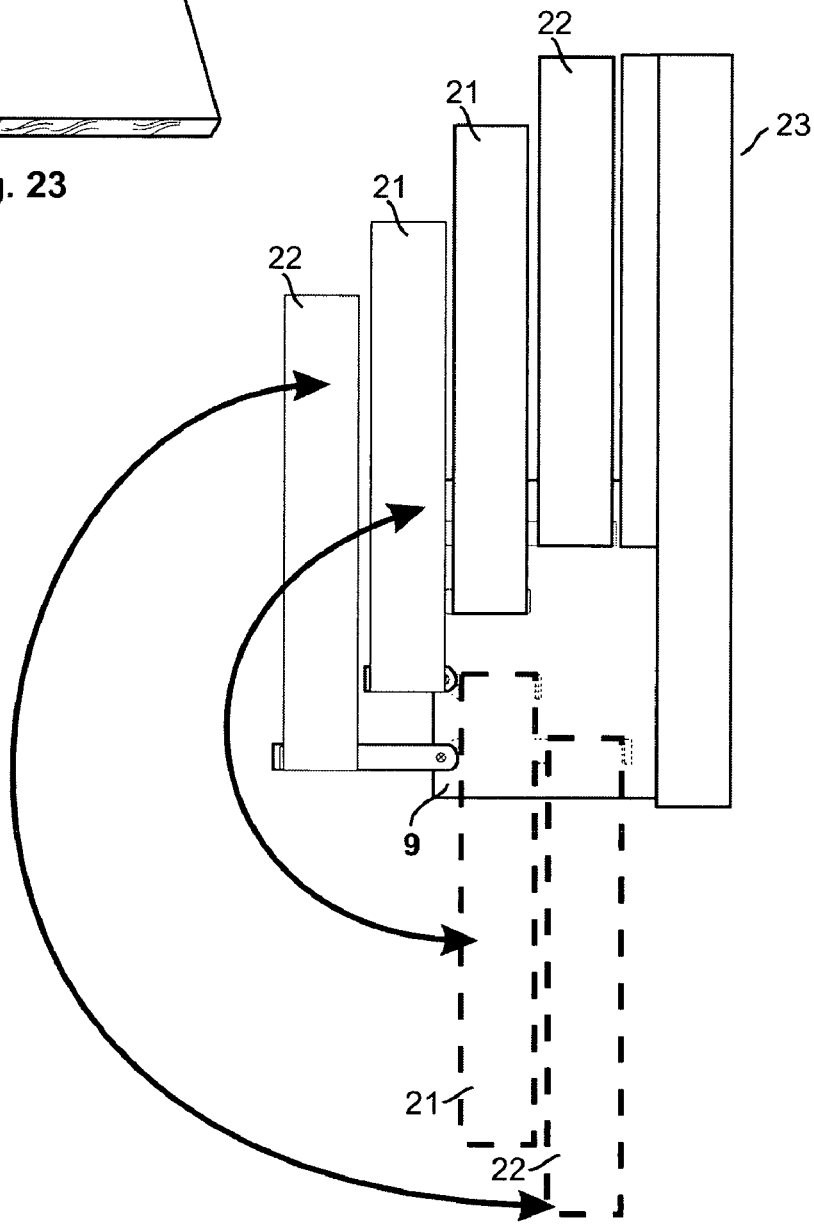
FIG. 24 is a top view of the device showing a pair of middle-position display panels and a pair of first-offset-position display panels, wherein all panels are nested substantially parallel to the backplane assembly, with dashed lines indicating approximately 180 degrees of movement for a middle-position display panel and a first-offset-position display panel.

For purposes of this patent, "nested" or "nesting together" refers to multiple moveable display panels being substantially parallel to one another, wherein the front of one display panel is adjacent the back of the next display panel, such as the panels defined by solid lines in FIG. 24.

Physical Description

Figure 2:
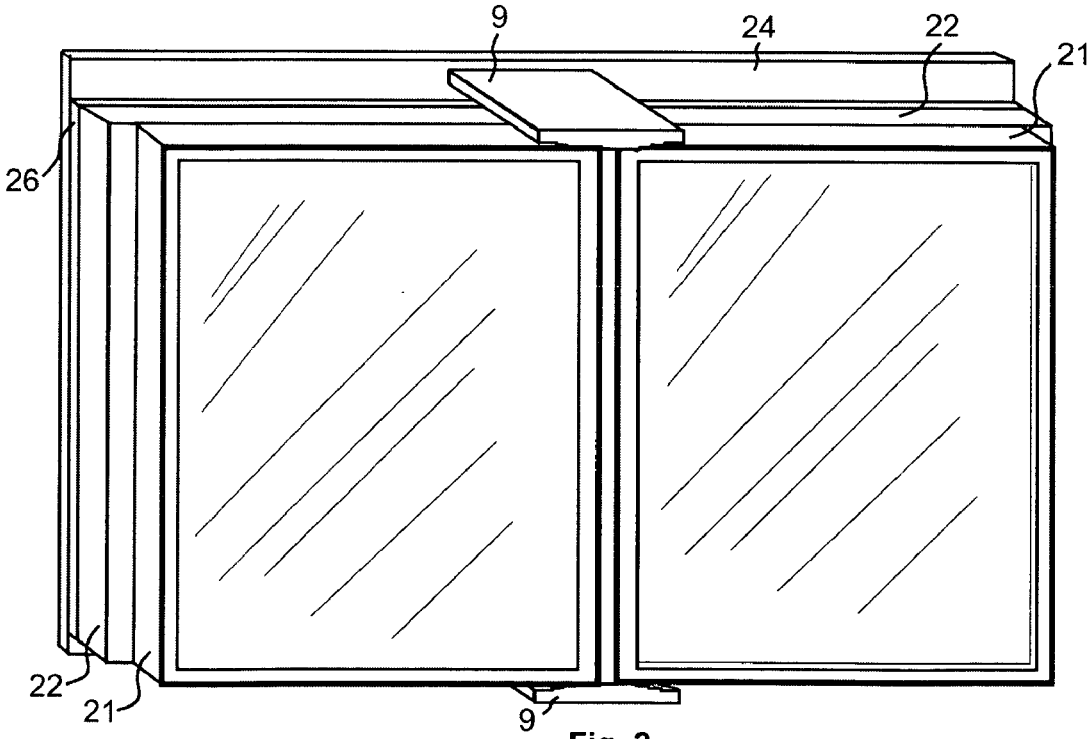
FIG. 2 is a perspective view of a display system incorporating two fixed-displays and four moveable display panels according to an alternative embodiment of the present invention.

A single fixed-display embodiment of the invention, ready for wall mounting, is shown in FIG. 1. The device shown in FIG. 1 comprises a single fixed-display backplane assembly 23, which incorporates one fixed-display 26 further comprising one viewable face, two pivot blocks 9, two middle-position display panels 21 wherein each middle-position display panel 21 comprises two viewable faces, and two first-offset-position display panels 22 wherein each first-offset-position display panel 22 also comprises two viewable faces. A very similar embodiment is shown in FIG. 2, and comprises a two fixed-display backplane assembly 24 with two fixed-displays 26 incorporated therein.

Referring now to FIG. 24, the display panels are in a preferred embodiment installed in pairs. A middle-position display panel 21 is installed in each of the two middle-positions in the center of pivot block 9. The first step away from the middle-position of the pivot block 9 is the first-offset-position, to which a first-offset-position display panel 22 is installed. In alternative embodiments, this nomenclature continues, and the next step away from the center position of the pivot block 9 is the second-offset-position to which a second-offset-position display panel 34 is installed. See FIG. 28. The next step down and away from the center position is the third-offset-position, and so on.

The invention comprises at least two versions of moveable two-sided display panels. The first version is intended for installation on either of two middle-position mounting bosses 30 (see FIG. 3) of the pivot blocks 9 of either backplane assembly 23 or 24, and is identified as a middle-position display panel 21. See FIG. 24. The second version is intended for installation on either of the two first-offset-position mounting bosses 31 (see FIG. 3), and is identified as a first-offset-position display panel 22. See FIG. 24. Display panels 21 and 22 differ from each other in that a short pivot arm 4 is used for the middle-position display panel 21 and a long pivot arm 7 is used for the first-offset-position display panel 22. See FIGS. 3, 8, and 11.

Display panels 21 and 22 are connected to the backplane assembly with a displacement rotation system (discussed infra) that incorporates two identical pivot blocks 9. See FIG. 3.

Figure 7:
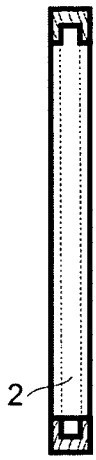
FIG. 7 is an end view of the U Shaped retention structure shown in FIG. 4, from a point of view looking toward an axis of rotation of the U Shaped retention structure.
Figure 4:
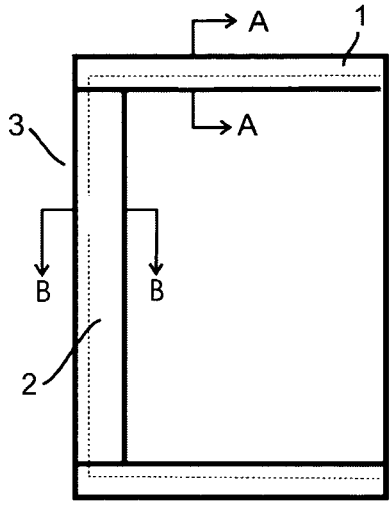
FIG. 4 is a front view of a U shaped retention structure.
Figure 5:
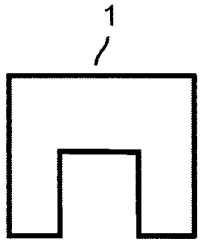
FIG. 5 is a cross sectional view of a retention rail taken along the line A-A in FIG. 4.
Figure 6:
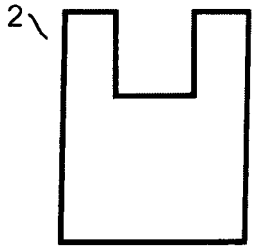
FIG. 6 is a cross sectional view of a retention bar taken along the line B-B in FIG. 4.
Figure 9:
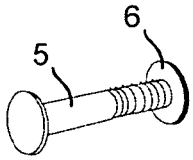
FIG. 9 is a perspective view of a pivot pin and pivot pin retention screw according to one embodiment of the present invention.

As shown in FIG. 4, two retention rails 1, channeled as shown in FIG. 5, are attached to a retention bar 2, channeled as shown in FIG. 6, to form a U shaped retention structure 3. An end view of the U shaped retention structure 3 is shown in FIG. 7. The length of the components of the U shaped retention structure 3 is determined by its intended use as part of a portrait-oriented or landscape-oriented moveable two-sided display. Thus, the U shaped retention structures 3 may exist in a variety of shapes. FIG. 4 shows a portrait-oriented U shaped retention structure 3 wherein the top and bottom retention rails 1 are shorter than the retention bar 2 on the side of the U shaped retention structure 3. In a landscape-oriented version, the lengths are in general reversed and the top and bottom retention rails 1 are longer than the retention bar 2.

Figure 3:
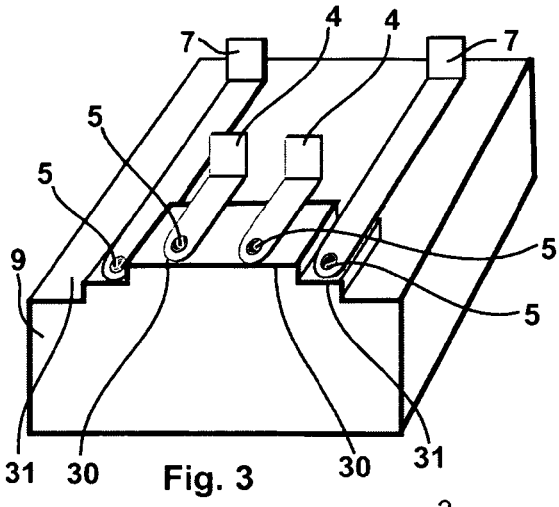
FIG. 3 is a perspective view of a pivot block/pivot arm.
Figure 8:
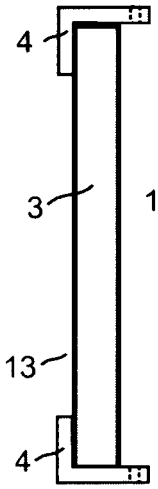
FIG. 8 is an end view of the U Shaped retention structure installed in a middle-position, from a point of view looking toward an axis of rotation of the U Shaped retention structure.
Figure 10:
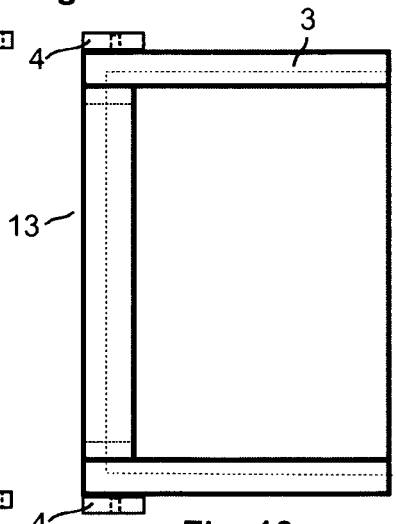
FIG. 10 is a front view of a U shaped retention structure prepared for installation in a middle-position.
Figure 16:
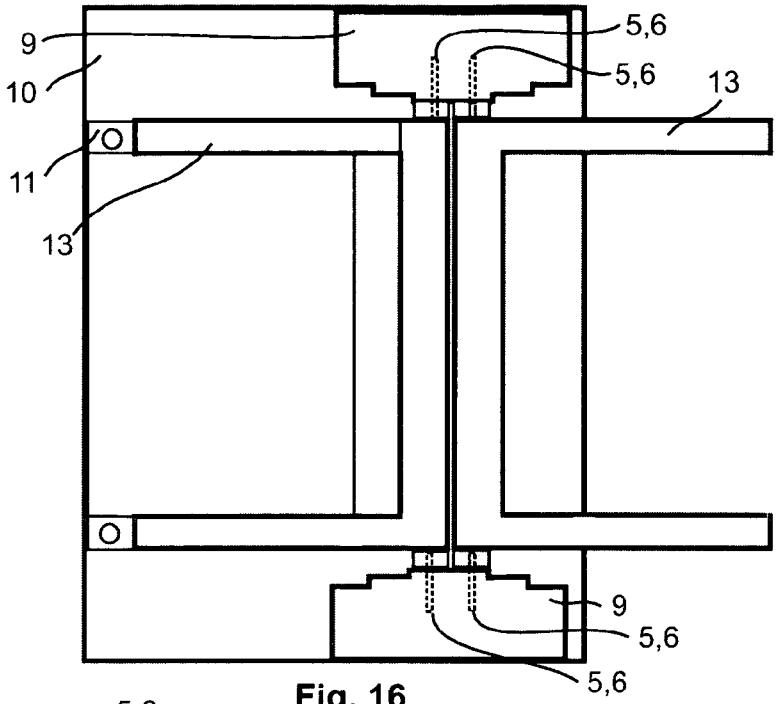
FIG. 16 is a front view of a pair of middle-position display panel retention structures mounted on a single fixed-display backplane assembly with one middle-position display panel retention structure rotated approximately 180 degrees from the other middle-position display panel retention structure.

The short pivot arm 4 used for the middle-position display panel 21 is shown in FIG. 3 and a side view of a middle-position retention structure 13 is shown in FIG. 8. In this embodiment, two short pivot arms 4 are attached to the U shaped retention structure 3 with the short pivot arms 4 installed perpendicular to the front of the unit to create the middle-position display panel retention structure 13 which holds the middle-position display panel 21. See FIGS. 8, 16 and 17. A front view of the middle-position retention structure 13 is shown in FIG. 10.

Figure 11:
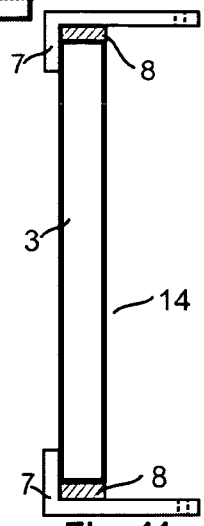
FIG. 11 is an end view of a U shaped retention structure prepared for installation in a first-offset-position, taken from a point of view looking toward an axis of rotation of the U Shaped retention structure.
Figure 12:
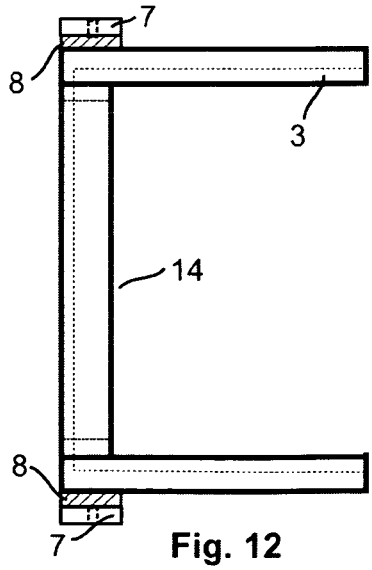
FIG. 12 is a front view of a U shaped retention structure prepared for installation in a first-offset-position.
Figure 17:
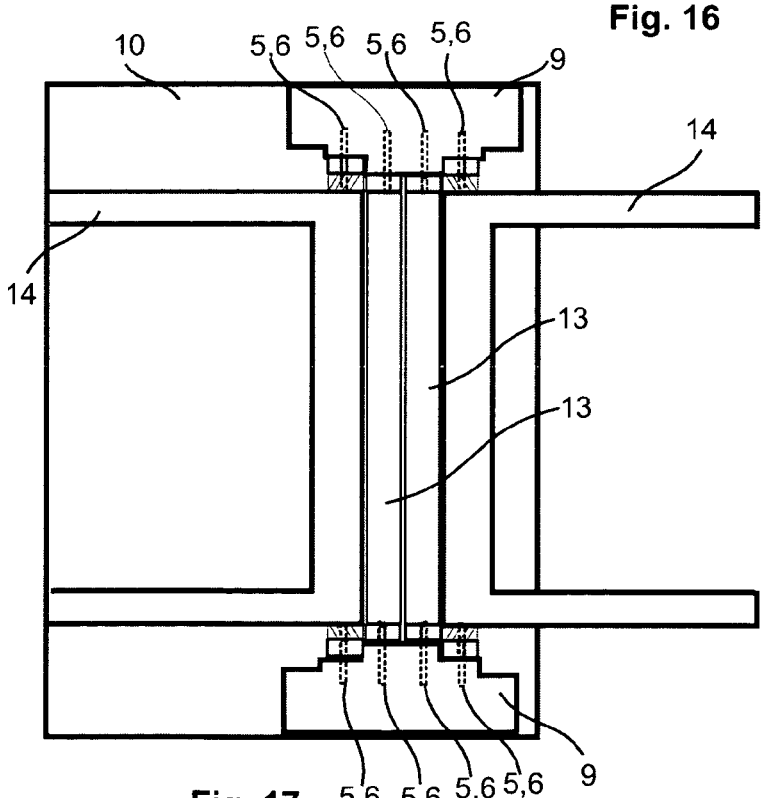
FIG. 17 is a front view of a pair of first-offset-position display panel retention structures and a pair of middle-position display panel retention structures mounted on a single fixed-display backplane assembly with one first-offset-position display panel retention structure rotated approximately 180 degrees from the other first-offset-position display panel retention structure.

The length of the pivot arms must correspond to the intended location of the moveable display panel. In the embodiments shown in FIGS. 1 and 2, a long pivot arm 7 is used for the first-offset-position display 22. See FIGS. 1-3. Two long pivot arms 7 are attached to the U shaped retention structure 3 with first-offset-position spacers 8 between the ends of the U shaped retention structure 3 and the pivot arms 7, with the pivot arms 7 installed perpendicular to the front of the unit to create a first-offset-position display panel retention structure 14 (FIGS. 11, 12 and 17). The first-offset-position display panel retention structure 14 holds a first-offset-position display panel 22. See FIGS. 2 and 17. A front view of the first-offset-position display panel retention structure 14 for a first-offset-position display panel is shown in FIG. 12.

Figure 13:
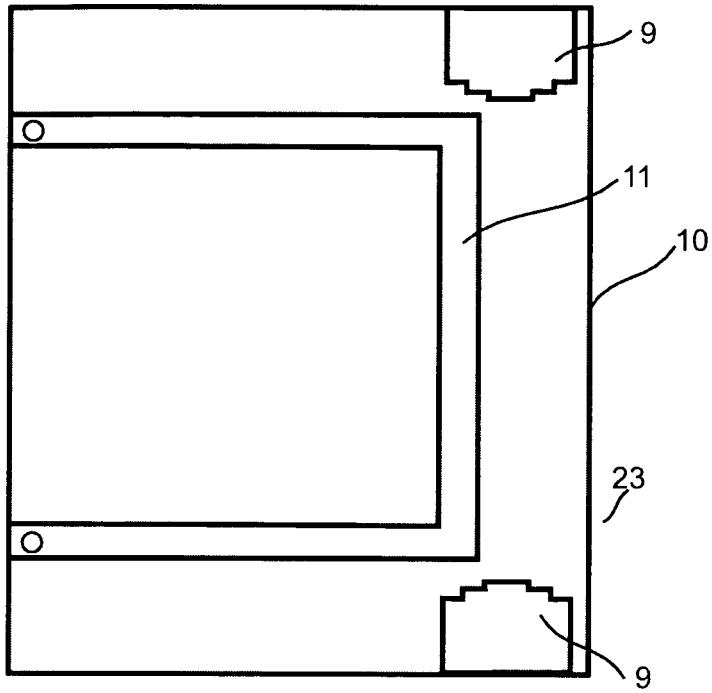
FIG. 13 is front view of a single fixed-display backplane assembly.
Figure 14:
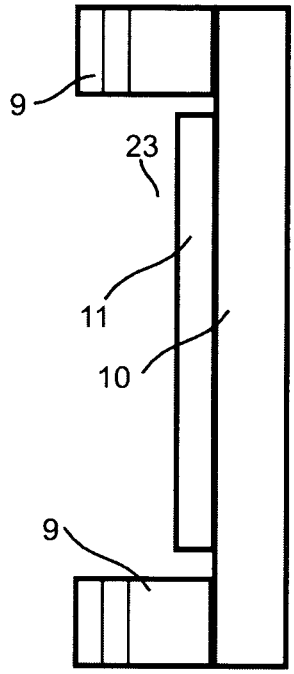
FIG. 14 is a side view of a backplane assembly.

In the embodiment shown in FIG. 1, two pivot blocks 9 and a fixed-display retention structure 11 are mounted on single fixed-display system backplate 10 to form the single fixed-display backplane assembly 23. See FIGS. 13-14. A side view of the single fixed-display backplane assembly 23 is shown in FIG. 14.

Figure 15:
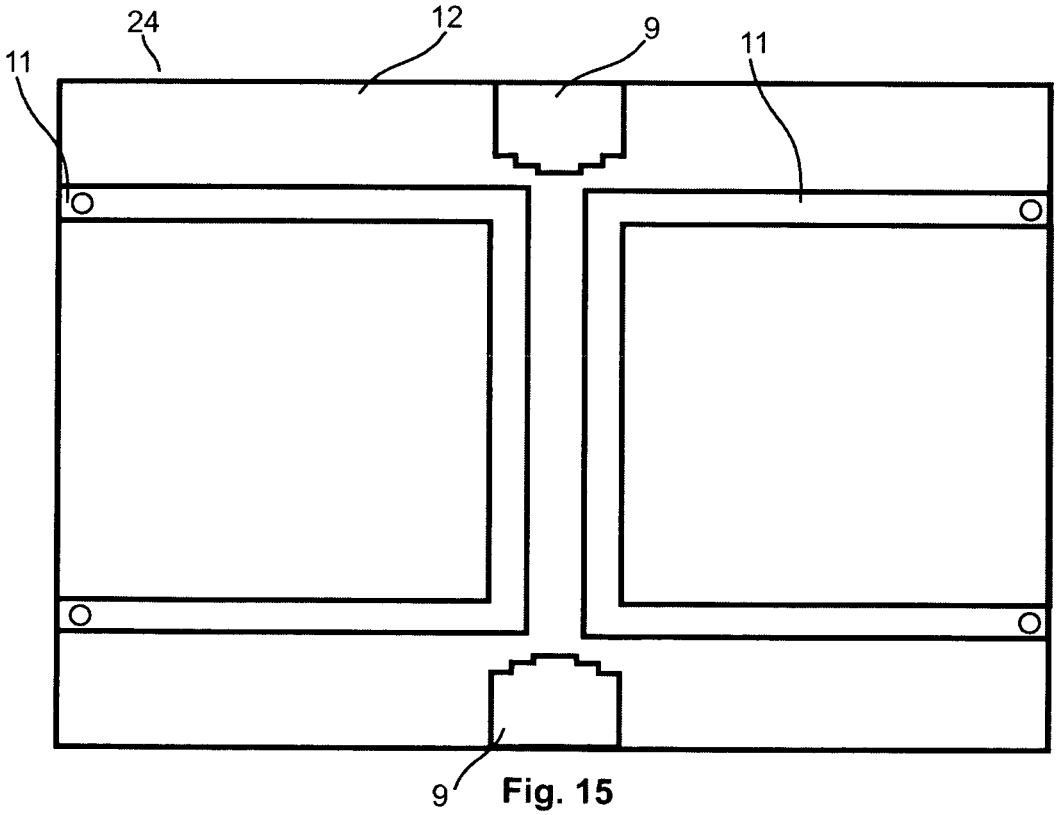
FIG. 15 is a front view of a two fixed-display backplane assembly.

The two-fixed-display backplane assembly is shown in FIG. 2, and further detail is shown in FIG. 15. The pivot blocks 9 are mounted in the middle of the two fixed-display backplane assembly 24. See FIG. 15.

In the embodiments shown in FIGS. 1 and 2, two middle-position display panel retention structures 13 are mounted on the middle bosses 30 of the pivot blocks 9 and are fastened with pivot pins 5 and pivot pin retention screws 6. In the embodiments shown in FIGS. 36 and 44 (described infra), different pivot pins are used.

In the embodiment shown in FIGS. 1 and 2, two first-offset-position display panel retention structures 14 are mounted on the first-offset-position mounting bosses 31 of the pivot block 9. See FIGS. 1, 3, 9, and 17. In the embodiment shown in FIG. 1, a single fixed-display backplane assembly 23 is used, and in the embodiment shown in FIG. 2, a two fixed-display backplane assembly 24 is used. See FIGS. 1 and 2. In either case, the first-offset-position display panel retention structures 14 are fastened to the first-offset-position mounting bosses 31 with pivot pins 5 and pivot pin retention screws 6. See FIGS. 1, 3,9 and 17.

Figure 18:
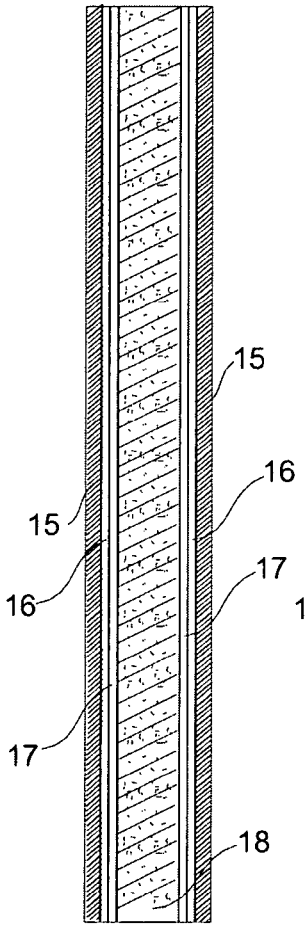
FIG. 18 is a side view of a two-sided display pack used for the two-sided moveable display panels, showing the internal structure of the two-sided display pack.

FIG. 18 is a side view of a typical two-sided display pack 19 comprising two transparent covers 15, two mats 16, two image sheets 17 that may contain one or more images, and a lightweight stiffener 18. See FIG. 18. The two-sided display packs 19 are interchangeable for all moveable display panels 21, 22, 48, and 57.

Figure 21:
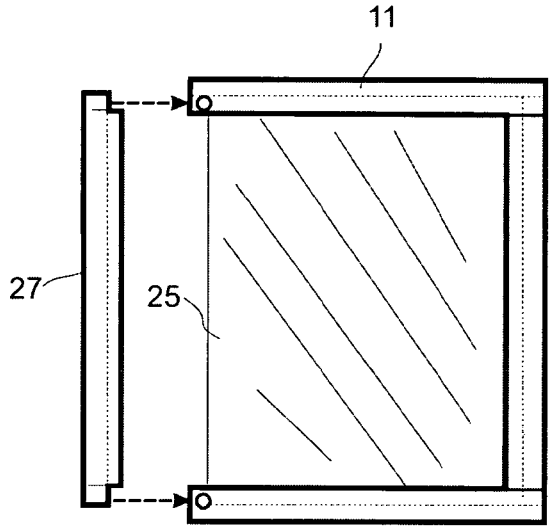
FIG. 21 is a front view of a fixed-display showing the installation of a single-sided display pack in the fixed-display.
Figure 19:
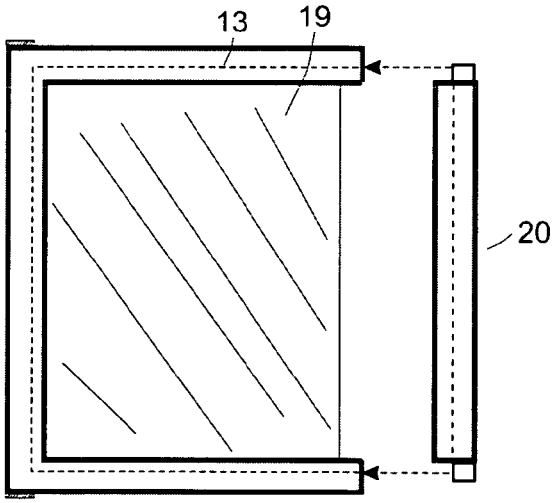
FIG. 19 is a front view of a middle-position display panel showing the installation of a removable display retention bar in the middle-position display panel.
Figure 22:
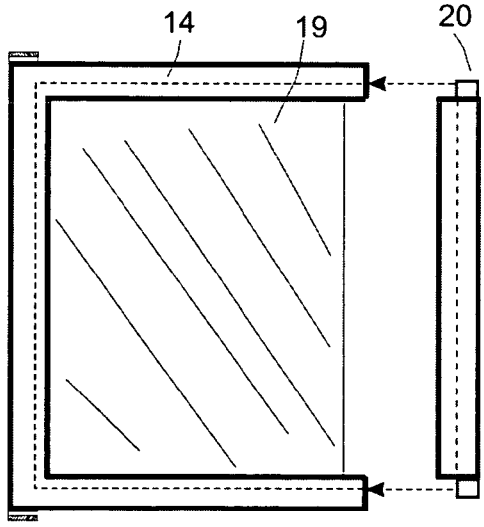
FIG. 22 is a front view of a first-offset-position display panel showing the installation of a two-sided display pack in the first-offset-position display panel.

FIG. 18 shows the display pack 19 inserted into the middle-position display panel retention structure 13 and held in place by a removable display retention bar 20. Removable display retention bar 20 provides access to the U shaped retention structure 3 channels and secures the two-sided display pack 19 when it is installed in a moveable display assembly. In one embodiment, two screws may pass through pre-drilled holes in the retention rails 1 into the ends of the removable retention bar 20 to secure the retention bar 20 to a moveable display panel. The completed assembly is a middle-position display panel 21. See FIG. 19. The same procedure is used to create the first-offset-position display panel 22 but uses the first-offset-position display panel retention structure 14. See FIG. 22. A similar procedure but using the fixed display retention bar 27 is shown in FIG. 21. After assembly, the moveable two-sided display panels may be modified by the addition of a mounting slot for use in the embodiment shown in FIG. 36 (discussed infra).

Figure 20:
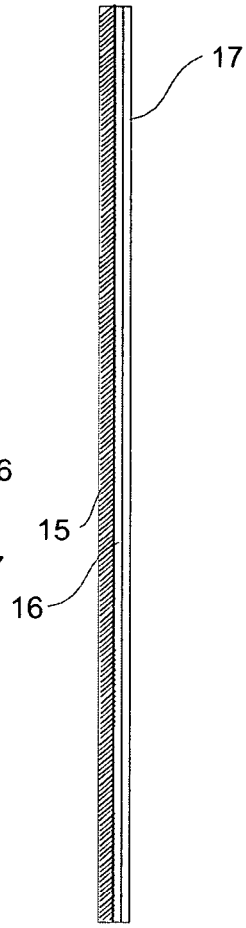
FIG. 20 is a side view of a single-sided display pack used for a fixed-display, showing the internal structure of the single-sided display pack.

A single-sided display pack 25 for a fixed-display 26 is shown in FIG. 20 and comprises a transparent cover 15, mat 16, and an image sheet 17 that may contain one or more images. The single-side display pack 25 is inserted into channels on the fixed-display retention structure 11 and held in place by a removable display retention bar 20. See FIGS. 13, 15, and 21. In the embodiments shown in FIGS. 1, 2, and 36, all retention rails 1 and retention bars 2 and 20 contain the same size channels.

In a preferred embodiment, the entire device may be wall mounted using predrilled holes in the backplate.

Figure 23:
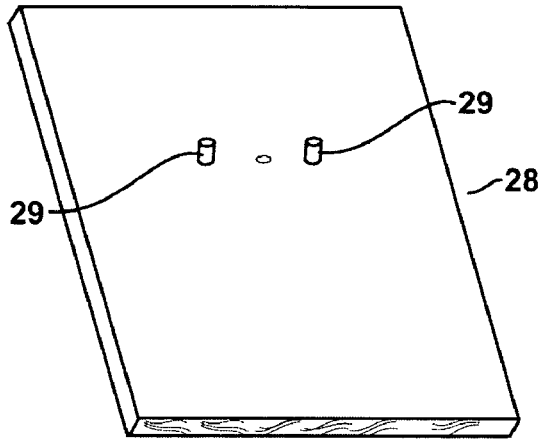
FIG. 23 is a perspective view of a baseplate according to an alternative embodiment of the invention.
Figure 42:
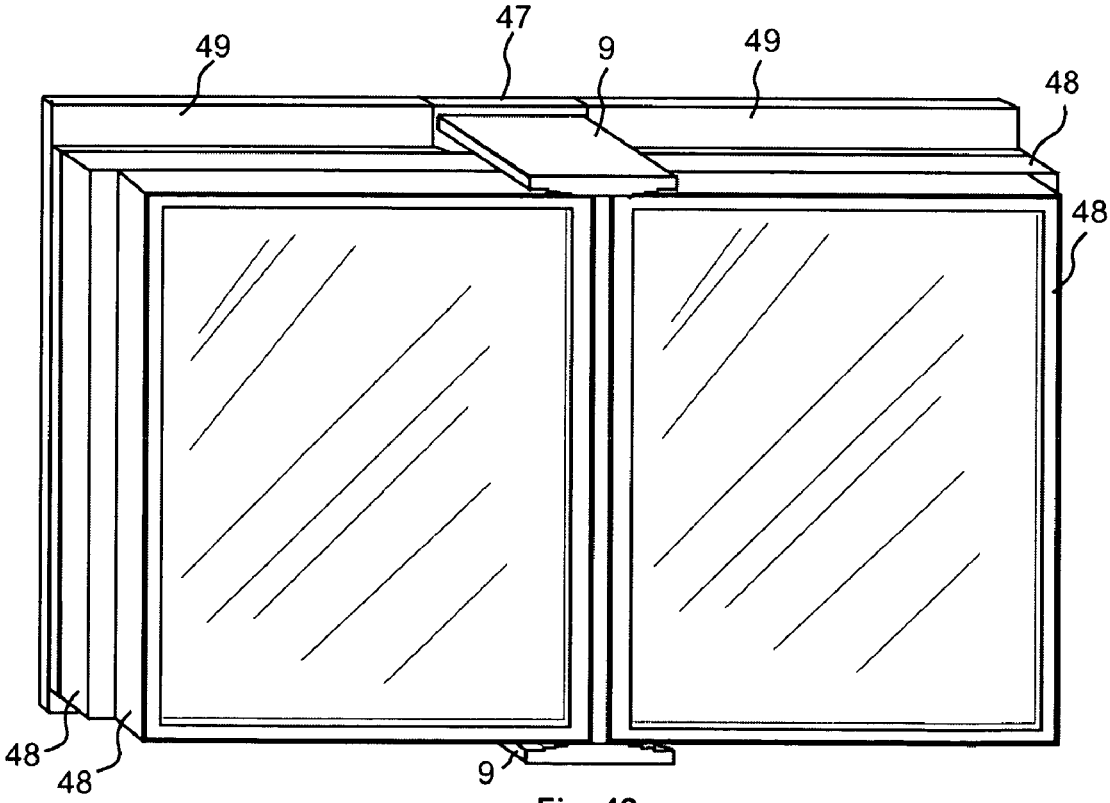
FIG. 42 is a perspective view of a display system having two backplane extensions.
Figure 43:
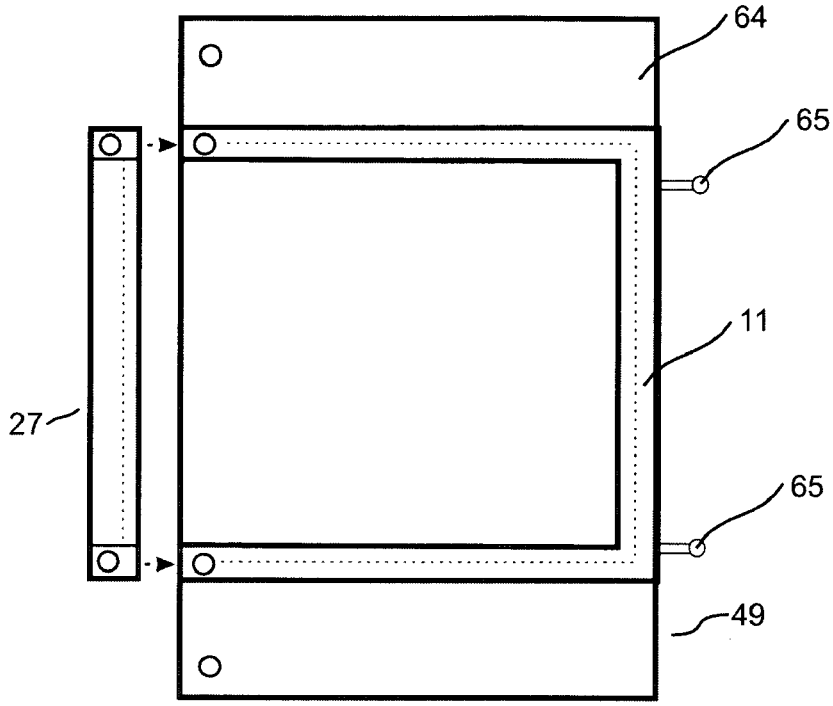
FIG. 43 is a front view of a backplane extension with a single fixed-display and quick connect fasteners.

In addition to being used as a wall-mounted device, the invention may be used as a table-mounted device with the baseplate 28 installed using holes predrilled in the either a single fixed-display system backplate 10 or a two fixed-display system backplate 12. See FIGS. 1, 2, and 23. The position of the alignment pins 29 installed in the baseplate 28 is shown in FIG. 23. In the embodiments shown in FIG. 36 and FIG. 44, the optional baseplate 28, and at least one backplane extension 49 are required for table-mounted operation. In the embodiment shown in FIG. 42, two backplane extensions are disclosed. Extension backplane fasteners 65 may fasten the backplane extension 49 to the narrow backplate 47, as shown in FIGS. 42 and 43. In a preferred embodiment, the display system is sufficiently rugged to allow its use for non-permanent displays after transport to a desired location.

In a preferred embodiment, the device may be constructed from wood, metal and plastic, but those materials are presented for purposes of illustration and not of limitation.

Displacement Rotation System

In a preferred embodiment, two identical pivot blocks 9 and their associated pivot arms 4 and 7 are integrated into each display system to create a displacement rotation system. See FIG. 3. In an alternative embodiment explained later in detail, the displacement rotation system comprises pivot blocks and pivot arm brackets. See FIGS. 36 and 44.

For the embodiments shown in FIG. 1 and FIG. 2, the intended mounting position on the mounting bosses 30, 31, 32 of the pivot block 9 determines what components have to be added to the basic retention structure 3. In these embodiments, the moveable display panels are identified by their mounting position on the pivot block 9. That is, in a display system equipped with four moveable display panels 21 and 22 as shown in FIG. 1 and FIG. 2, pivot blocks 9 comprise two short pivot arms 4 on the middle-position mounting bosses 30 and two long pivot arms 7 for moveable display panels mounted on the first-offset-positions mounting bosses 31. The pivot arms 4 and 7 are attached to the basic retention structures 3 to construct the middle-position display panels 21 and first-offset-position display panels 22. For the embodiments shown in FIG. 36 and FIG. 44, the pivot arm brackets are specific to each mounting position and the detachable moveable display panels are identical and interchangeable.

The displacement rotation system has three functions, which will be described in turn. First, it provides stable support for the moveable display panels both at rest and at any point in the field of rotation. Second, it provides nesting of stacks of moveable two-sided display panels anywhere in the field of rotation. Third, it provides interference-free approximately 180-degree rotation of the moveable two-sided display panels.

Figure 25:
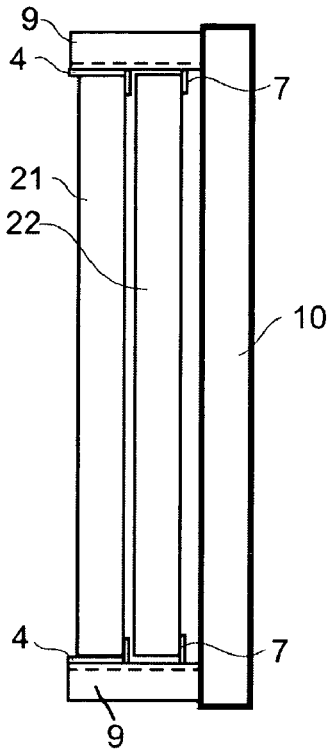
FIG. 25 is a cut away side view of the stable support system, showing among other things, the side of two display panels closest to the axis of rotation of the two display panels.
Figure 27:
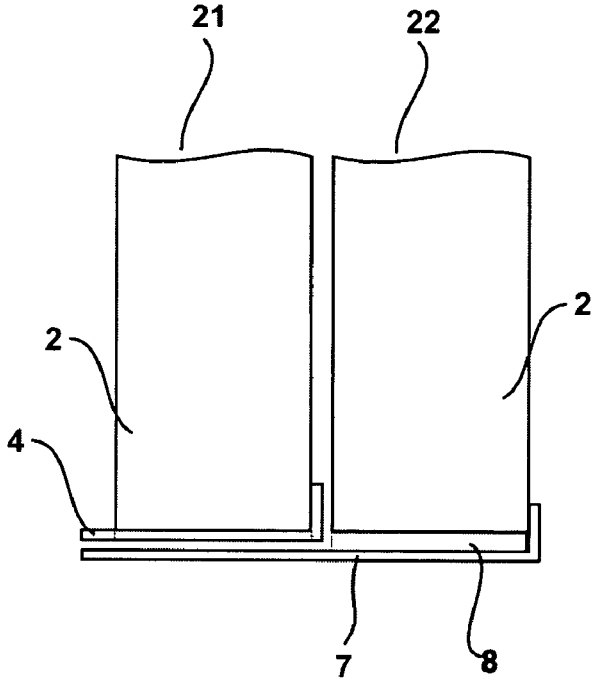
FIG. 27 is a side view of a middle-position display panel adjacent to a first-offset-position display panel.

The displacement rotation system achieves this stable support of moveable display panels by attaching a pair of pivot arms to the top and bottom of the moveable two-sided display panels 21, 22, 48, or 57. As shown in FIG. 25, the short pivot arms 4 of middle-position display panel 21 are pinned to pivot blocks 9, which in turn are attached a backplane assembly 23, 24 or 56. See FIGS. 24 and 44. Note, some details (fixed-display, pivot pins) have been omitted from FIG. 25 for clarity of presentation. FIG. 27 illustrates the height difference of short pivot arm 4 and long pivot arm 7.

Figure 26:
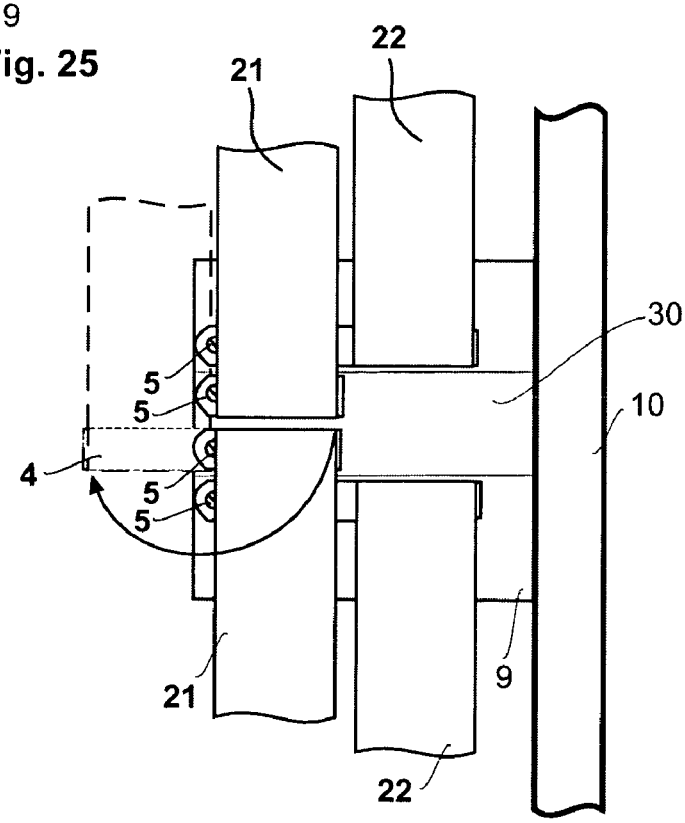
FIG. 26 is a fragmentary plan view of a pair of middle-position display panels, and a pair of first-offset display panels, mounted on a pivot block, with dashed lines showing the position of a middle-position moveable two-sided display panel after being rotated approximately 180 degrees.

The nesting of moveable display panels requires a simultaneous rotation and displacement of the display panels. FIG. 25 shows the connection of the pivot arms 4 and 7 to the pivot blocks 9. FIG. 26 is a top view of four moveable display panels 21 and 22, and does not show the upper portion of the display panels and backplane assembly. All the pivot pins of the display panels 21, 22 are spaced on a line parallel to the single fixed-display system backplate 10. See FIG. 26. When a middle-position display panel 21 is deviates from the position shown in FIG. 26, the pivot arm displaces the display panel a distance equal to the width of middle-position display panel 21 plus the distance from the face of the display to the center of the pivot pin. This provides sufficient clearance to allow the middle-position display panel 21 to be rotated to a position parallel the other middle display panel 21. The first-offset-position display panel 22, shown adjacent to the single fixed-display backplate 10 may be rotated and stacked in a similar manner. See FIG. 26. FIG. 27 illustrates the difference in the length of pivot arms 4 and 7 of the middle display panel 21 and the first-offset-position display panel 22. This difference in pivot arm length is sufficient to allow the first-offset-position display panel 22 to be rotated and stacked parallel to the middle-position display panel 21.

With regard to the elimination of interferences, there are two sources of interference during rotation of a moveable display panel. The first is the degree of clearance between the back of one panel and the front of the adjacent nested panel. For example, when a nested moveable middle display panel 21 is rotated, the back edge of the panel swings in an arc set by the length of short pivot arm 4. See FIG. 26. The length of the long pivot arm 7 as shown in FIG. 27 includes the increment of length required to create the necessary clearances of nested panels during rotation.

Figure 29:
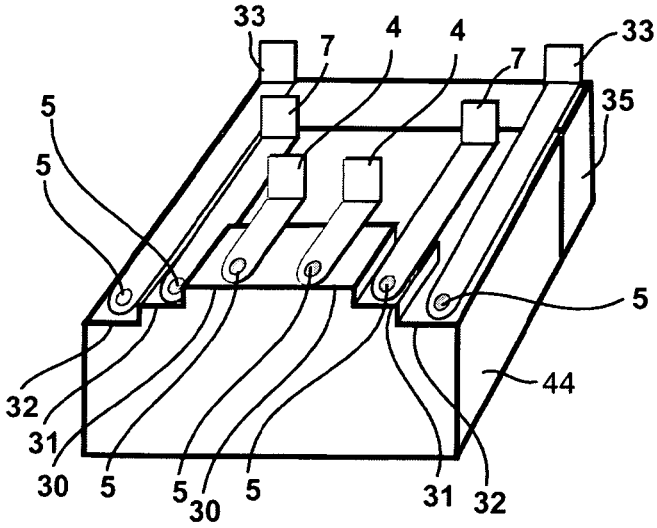
FIG. 29 is a perspective view of a pivot block/pivot arm assembly configured to support six moveable display panels, according to an alternative embodiment of the present invention.

The second source of interference is when adjacent pivot arms are mounted in the same plane of motion. To avoid this problem, the pivot block 9 is equipped with mounting bosses 30, 31, 32 at different heights. See FIGS. 3 and 29. The basic U shaped retention structures 3 used to construct the moveable display panels are the same size. As shown in FIG. 29, to match with the height differences of the mounting bosses 30, 31, and 32 on the pivot block 9, first-offset-position spacer 8 is with the longer pivot arm 7. See FIGS. 11, 12, and 29. This creates a span difference between the pivot arms of the middle-position display panel 21 and the first-offset-position display panel 22 and allows free rotation of either display panel. This allows adjacent moveable two-sided display panels can be moved together while remaining nested. Note that spacers are not required in the embodiment of the invention employing bracket pivot arms (discussed infra).

Functional Description

The present invention has a footprint substantially equal to that amount of space required for one conventional fixed-display, or, in the embodiment shown in FIG. 2, substantially equal to that space required for two conventional fixed-displays.

One objective of the invention is to provide a decorative wall-mounted display system that will allow sequential viewing of a set of multiple images such as photographs, drawings, and other illustrations in the wall space normally required for one image, with the images mounted in a set of moveable two-sided display panels that can be stacked flat against the wall or backplane assembly. See FIGS. 1, 2, and 24.

In operation, the moveable two-sided display panels may freely rotate through an arc of 180 degrees about an axis of rotation, stay in a position selected by the viewer, and store flat against the wall or backplane assembly 23 or 24. See FIGS. 24 and 26. As shown supra, the displacement rotation system accomplishes this by displacing the moveable two-sided display panels an appropriate distance during rotation to allow a pair of panels to lie substantially flat against each other anywhere in the field of rotation. In FIG. 24 a set of four moveable display panels 21 and 22 are shown stacked flat against the backplane assembly 23. FIG. 24 also shows with dashed lines the position of the two outermost moveable display panels 21, 22 after rotation through a 180-degree arc.

OTHER EMBODIMENTS OF THE INVENTION

Figure 36:
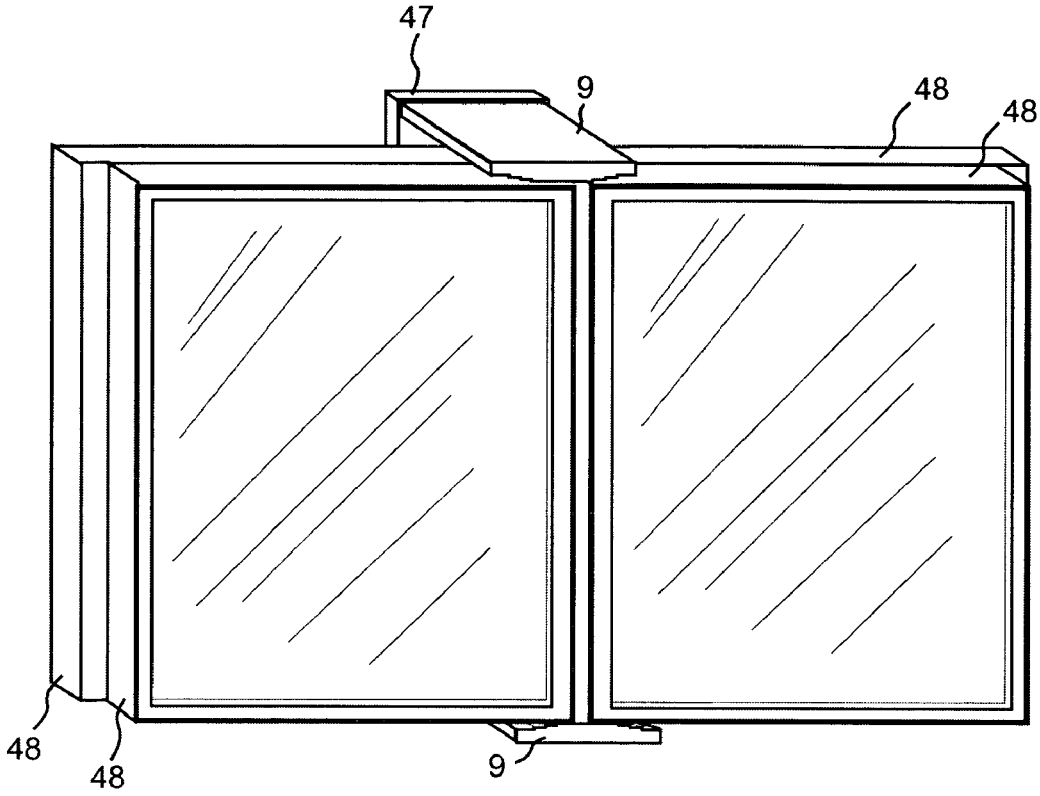
FIG. 36 is a perspective view of a display system having a narrow backplane assembly and four moveable two-sided display panels.
Figure 37:
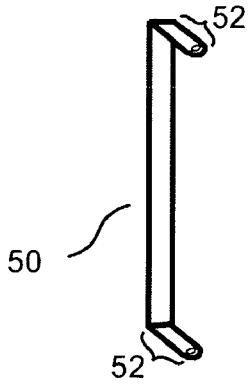
FIG. 37 is a perspective view of a middle-position bracket pivot arm incorporated into a middle-position pivot arm bracket.
Figure 38:
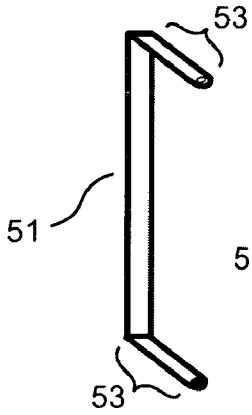
FIG. 38 is a perspective view of first-offset-position bracket pivot arm incorporated into a first-offset-position pivot arm bracket.
Figure 39:
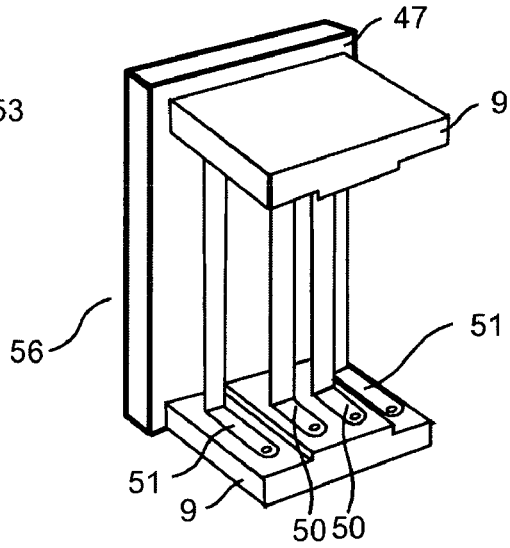
FIG. 39 is a perspective view of a narrow backplane assembly with four pivot arm brackets.
Figure 40:
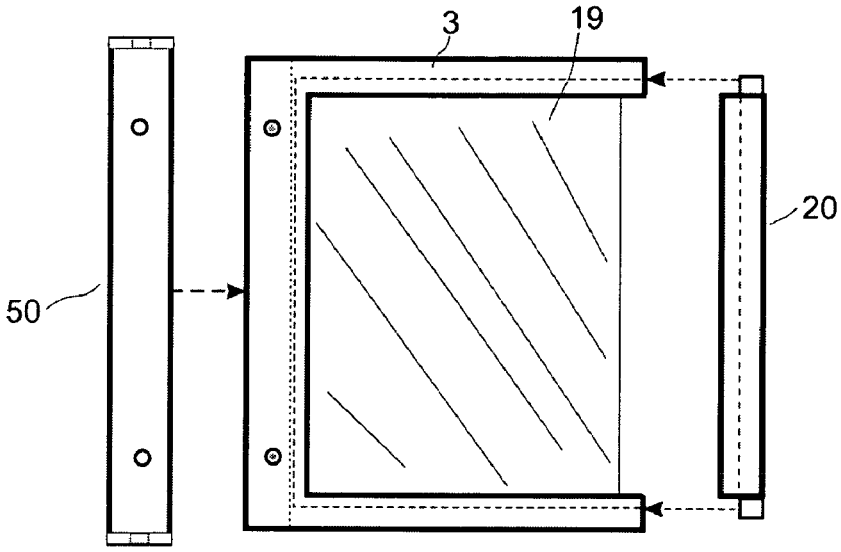
FIG. 40 is a front view of a detachable moveable display panel, with arrows indicating direction for assembly.
Figure 41:
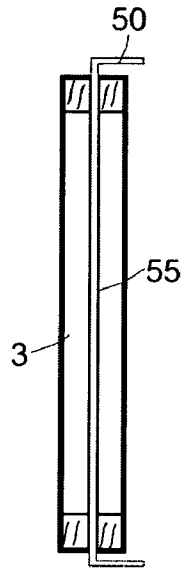
FIG. 41 is a left side view of a display panel installed on a mounting bracket, showing a pivot arm in a pivot bracket.

In an alternative embodiment of the invention, the device comprises four detachable moveable display panels 48 as shown in FIG. 36. This embodiment differs from that shown in FIGS. 1 and 2 in four ways. First, the middle-position bracket arms 52 (compare to short pivot arm 4) are incorporated into the middle-position pivot arm bracket 50. See FIGS. 3 and 37. Second, the first-offset-position bracket pivot arms (compare to long pivot arm 7) 53 are incorporated into the first-offset-position pivot arm bracket 51. See FIGS. 3 and 38. Third, the display panels in this embodiment are detachable moveable display panels 48 and can be readily detached from the device. Finally, a narrow backplate 47 is used. See FIGS. 36 and 39. The device shown in FIG. 36 comprises a narrow backplane assembly 47, a middle-position pivot arm bracket 50 fastened to the pivot blocks 9 with fixed pivot pins 54, and a first-offset-position pivot arm bracket 51, also fastened to the pivot blocks 9. The function of the pivot arm brackets 50 and 51 and pivot block 9 combination is the same as that of the separate pivot arms 4 and 7 and pivot block 9 combination. See FIGS. 3 and 39. The detachable moveable display panel 48, shown in FIGS. 40-41, incorporates a mounting slot 55 on the closed side of the U shaped retention structure 3, as shown in FIG. 41. Mounting slot 55 mates with the vertical portion of the pivot arm bracket and the two are fastened together in a non-permanent fashion. See FIG. 41. Thus, using slot-mounted pivot arm brackets that incorporate the pivot arms, the embodiments shown in FIGS. 36 and 44 stand in contrast to the separate pivot arms of the embodiments shown in FIG. 1 and FIG. 2. The pivot arm brackets 50 and 51 in the embodiments shown in FIGS. 36 and 44 are part of the narrow backplane assembly.

The two-sided display pack 19 can be removed and replaced whether the device is wall mounted or laying on a work surface. In either case, access to the two-sided display pack 19 is gained by removing the moveable display retention bar 20 from the device, as shown in FIG. 40. In the embodiment shown in FIG. 36, the detachable moveable display panels 48 are identical and interchangeable. Extension panels 64 that may incorporate a fixed-display retention structure 11 can be fastened on either or both sides of the narrow backplane assembly 56. See FIGS. 42-44. In the configuration shown in FIG. 42, two backplane extension panels 49 are attached to the narrow backplate 47.

Finally, the embodiments shown in FIGS. 36 and 42 allow the use of identical detachable moveable display panels for all positions and do not require spacers for the offset-positions. See FIGS. 11, 12, 36, and 42.

Figure 44:
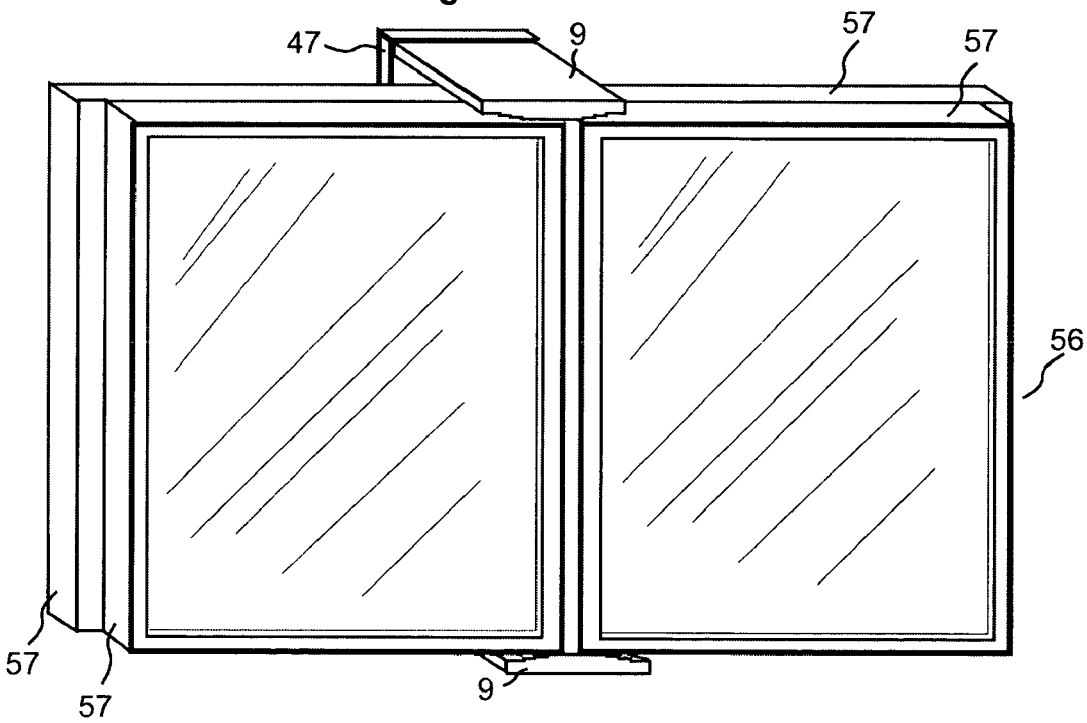
FIG. 44 is a perspective view of a display system having a narrow backplane assembly and four theft-resistant detachable moveable display panels.
Figure 45:
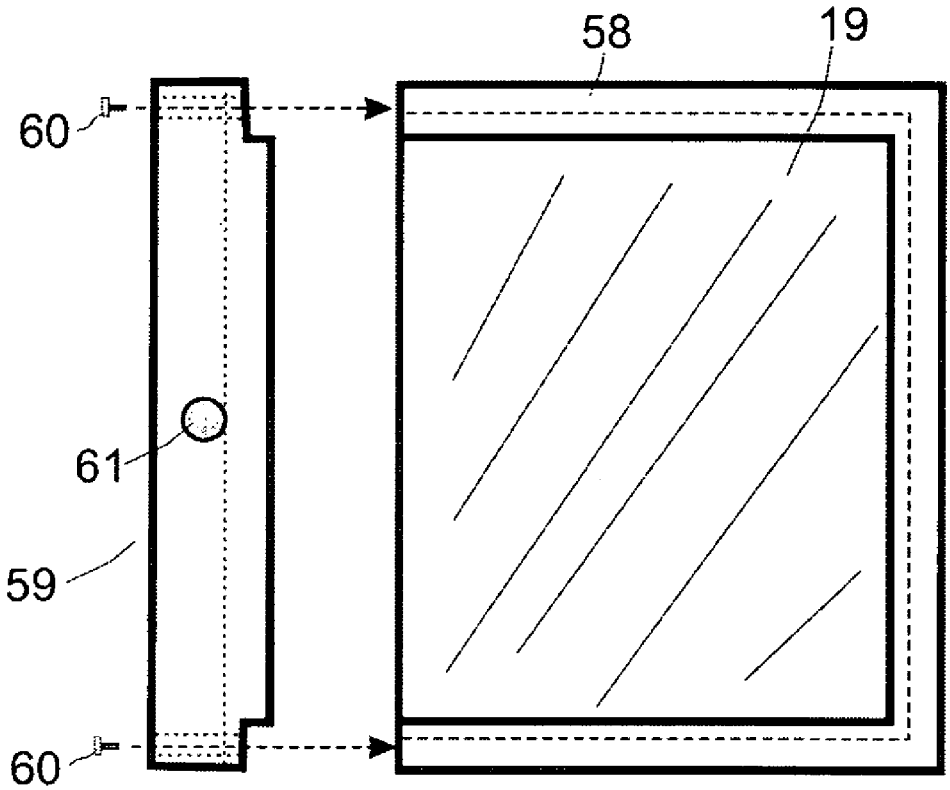
FIG. 45 is a front view of a theft-resistant detachable moveable display panel, with arrows indicating direction for assembly.
Figure 46:
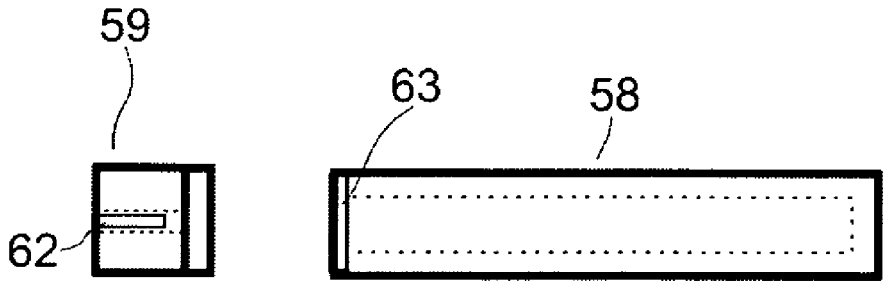
FIG. 46 is a top view of a slotted backbone of a theft-resistant moveable display panel, according to an alternative embodiment of the invention.

An additional embodiment of the invention is shown in FIG. 44. This embodiment comprises a narrow backplane assembly 56 and four identical theft-resistant display panels 57. See FIG. 44. The theft-resistant display panels 57 are shown in detail in FIG. 45. Access to the two-sided display packs 19 is blocked when the theft resistant display panels 57 are installed on the narrow backplane assembly 47. See FIGS. 44-45. As shown in FIG. 45, the theft-resistant display panel 57 must be uninstalled to allow access to display pack access fasteners 60 that attach a theft resistant U shaped retention structure 58 to a slotted backbone 59, but to allow access a lock device 61 must first be defeated. The slotted backbone 59 comprises a backbone-mounting slot 62 as shown in FIG. 46. Threaded tabs 63 may be used to secure the theft resistant U shaped retention structure 58 to the slotted backbone 59. See FIG. 46. The pivot arm brackets 50 and 51 are mounted in the backbone mounting slots 62 in the slotted backbone 59 of the theft resistant display panel 57 and are fastened in place in a manner similar to that shown in FIG. 41. In one embodiment the lock device 61 is a typical lock requiring a key to open. See FIG. 45.

Figure 28:
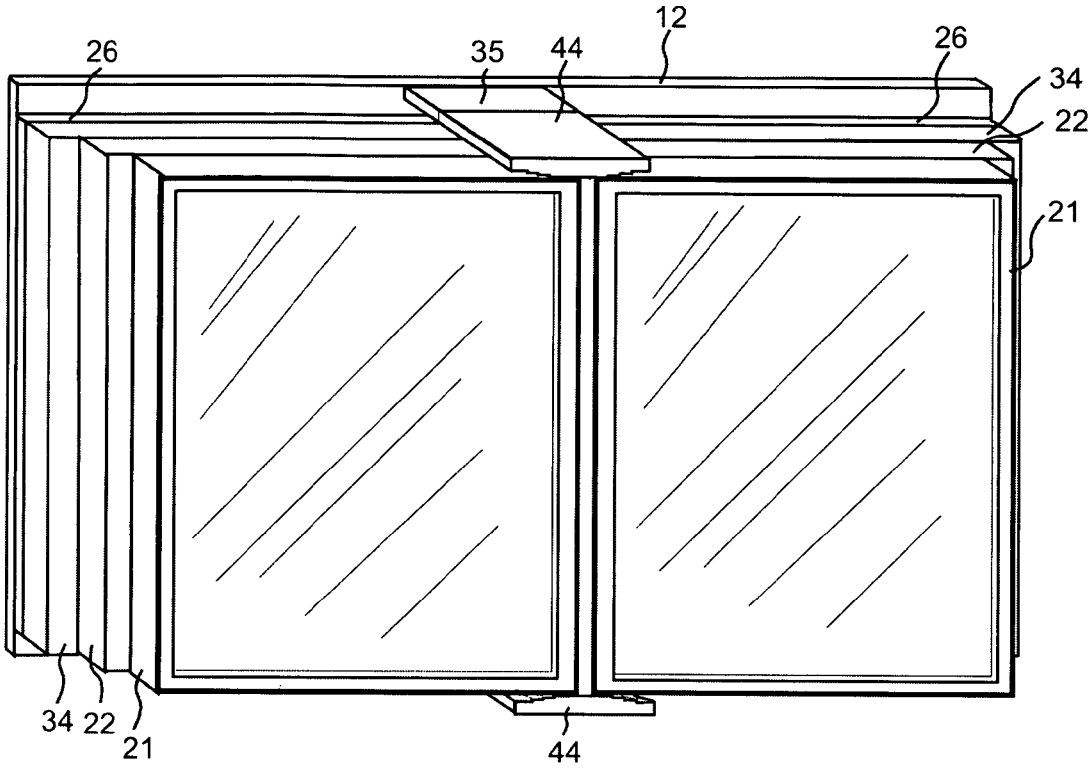
FIG. 28 is a perspective view of a display system incorporating two fixed-displays and six moveable display panels, according to an alternative embodiment of the present invention.
Figure 30:
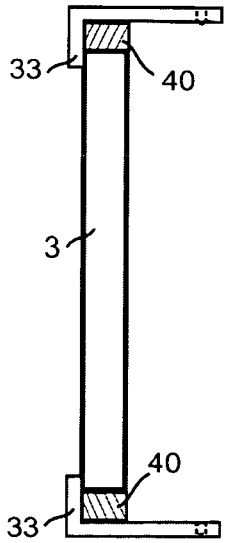
FIG. 30 is a left side view of a second-offset-position display panel retention structure.
Figure 31:
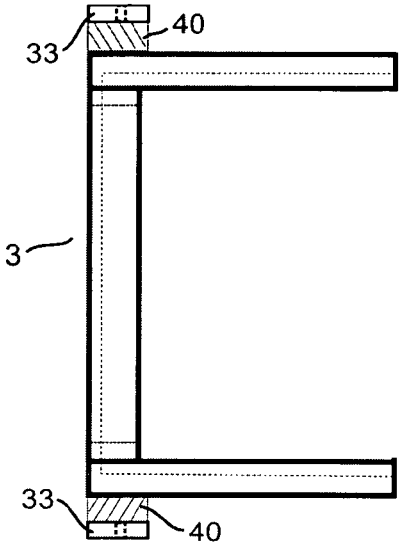
FIG. 31 is a front view of a second-offset-position display panel retention structure.

An alternative embodiment of the invention comprising six moveable display panels 21, 22, 34 is shown in FIG. 28. A six-display pivot block 44, with short pivot arms 4, long pivot arms 7, and second-offset-position pivot arms 33, and a pivot block spacer 35 is shown in FIGS. 28 and 29. The pivot block spacer 35 allows the second-offset-position pivot arm 33 to be used for the second-offset-position display panel 34. See Id. The system functions similarly to the systems shown in FIGS. 1 and 2, but with six moveable displays instead of four. FIG. 30 shows a U shaped retention structure 3, a second-offset-position pivot arm 37 and a second-offset-position pivot spacer 40. Displays mounted on the second-offset-position mounting bosses 32 are shown in FIGS. 30 and 31.

Figure 33:
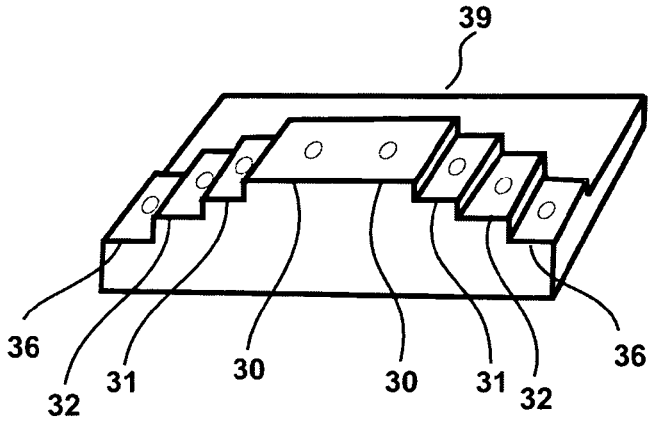
FIG. 33 is a perspective view of a pivot assembly configured to support eight moveable display panels.
Figure 32:
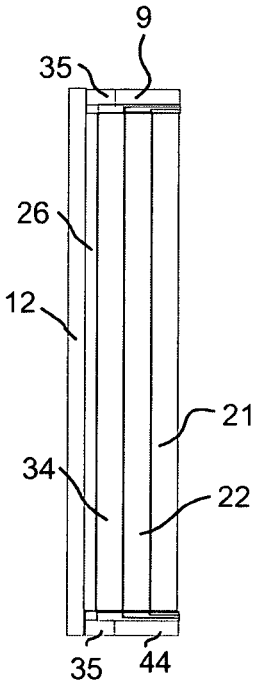
FIG. 32 is a left side view of a display system having six moveable display panels according to an alternative embodiment of the invention.
Figure 34:
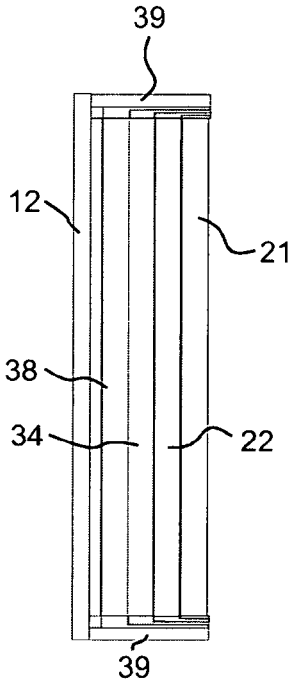
FIG. 34 is a left side view of a display system having eight moveable two-sided display panels.

FIG. 33 shows an eight-display pivot block 39 with four sets of mounting bosses 30, 31, 32, and 36, and is required in an embodiment comprising eight moveable display panels 21, 22, 34, 42. See FIGS. 33-34. This embodiment is similar to those previously described, and further comprises two third-offset-position display panels 38, mounted on the third-offset-position mounting bosses 36. See FIGS. 33-34. FIG. 34 shows a side view of this embodiment.

Figure 35:
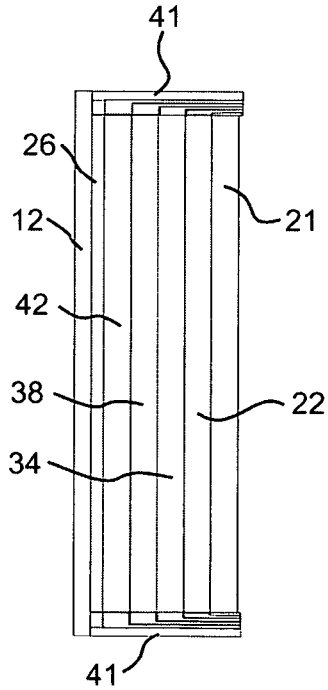
FIG. 35 is a left side view of a display system having ten moveable two-sided display panels.

A ten-display pivot block 41 with five pairs of mounting bosses is required for an embodiment two middle-position display panels 21, two first-offset-position display panels 22, two second-offset display panels 34, two third-offset-position display panels 38, and two fourth-offset-position display panels 42, as shown in FIG. 35.

For other embodiments of the invention, the size and number of pivot block mounting bosses may be customized to support the number of moveable two-sided display panels to be included in a system. As the number of moveable two-sided display panels incorporated into the device increases, the length of the pivot arm increases for each offset-position. Additionally, the embodiment containing six, eight, and ten moveable display panels may also comprise the pivot arm brackets described supra.

By reference to the descriptions above, it is evident that other embodiments can be constructed using the principles underlying the pivot block/pivot arm assemblies described herein. Thus, one skilled in the art will appreciate that the present invention can be practiced by other than the preferred embodiments, which are presented for purposes of illustration and not of limitation.

I claim:

1. A display system, comprising:

a. a first pivot block;

b. a second pivot block;

c. a first mounting boss on said first pivot block, said first mounting boss having a first mounting boss height;

d. a second mounting boss on said second pivot block, said second mounting boss has a second mounting boss height;

e. a first pivot bracket arm attached to said first mounting boss and said second mounting boss, wherein said first pivot bracket arm has a first length;

f. a third mounting boss on said first pivot block, wherein said third mounting boss has a third mounting boss height that is less than said first mounting boss height;

g. a fourth mounting boss on said second pivot block, wherein said fourth mounting boss has a fourth mounting boss height that is less than said second mounting boss height;

h. a second pivot bracket arm attached to said third mounting boss and said fourth mounting boss, wherein said second pivot bracket arm has a second length and wherein said first length is less than said second length;

i. a first display unit attachable to said first pivot bracket arm; and j. a second display unit attachable to said second pivot bracket arm.

2. The display system according to claim 1, additionally comprising a means for locking to inhibit unauthorized removal of said display units.

3. The display system according to claim 1, additionally comprising a first mounting slot in said first display unit, and a second mounting slot in said second display unit.

4. A method of displaying items, comprising:

a. providing a display system according to claim 3;

b. sliding said first pivot bracket arm into said first mounting slot of said first display unit; and c. sliding said second pivot bracket arm into said second mounting slot of said second display unit.

5. The method according to claim 4, additionally comprising mounting said system to a wall for display.

6. The method according to claim 4, additionally comprising attaching a base to said system so that said system can be displayed on a table or other horizontal surface.

* * * * *